United States Patent [19]

Ikegami et al.

[11] Patent Number: 4,703,154

[45] Date of Patent: Oct. 27, 1987

[54] INFRARED RAY HEATER

[75] Inventors: Ryoichi Ikegami, Nagoya; Hitoshi Kojima, Tokai, both of Japan

[73] Assignee: NGK Insulators, Ltd., Aichi, Japan

[21] Appl. No.: 813,681

[22] Filed: Dec. 26, 1985

[30] Foreign Application Priority Data

Aug. 6, 1985 [JP] Japan ..... 60-120383[U]

[51] Int. Cl.[4] ..... H05B 3/18; H05B 3/48

[52] U.S. Cl. ..... 219/345; 219/542; 219/544

[58] Field of Search ..... 219/345, 354, 357, 542, 219/544; 338/283–289

[56] References Cited

U.S. PATENT DOCUMENTS

| | | | |
|---|---|---|---|
| 1,551,868 | 9/1925 | Clark et al. | 219/542 |
| 1,664,429 | 4/1928 | Multhaup | 219/542 |
| 1,694,600 | 12/1928 | Lee | 338/286 |
| 1,881,241 | 10/1932 | Potensa | 219/544 |
| 2,255,518 | 9/1941 | Norton | 219/542 |
| 3,020,379 | 2/1962 | Ludlow et al. | 219/345 |
| 3,163,841 | 12/1964 | Willett | 219/345 |
| 3,479,490 | 11/1969 | Stark | 219/345 |
| 3,499,232 | 3/1970 | Zimmermann | 219/345 |
| 3,564,475 | 2/1971 | Fujii et al. | 338/287 |
| 3,808,573 | 4/1974 | Cappell | 219/345 |
| 3,859,498 | 1/1975 | Steinmetz | 219/345 |
| 4,331,878 | 5/1982 | Steinmetz | 219/345 |
| 4,591,697 | 5/1986 | Lexer | 219/354 |

FOREIGN PATENT DOCUMENTS

| | | | |
|---|---|---|---|
| 2407619 | 8/1975 | Fed. Rep. of Germany . | |
| 2624729 | 12/1977 | Fed. Rep. of Germany | 219/354 |
| 60-26194 | 2/1985 | Japan | 219/345 |
| 8201293 | 4/1982 | PCT Int'l Appl. | 219/345 |
| 1543341 | 4/1979 | United Kingdom | 219/345 |
| 1581127 | 12/1980 | United Kingdom | 219/345 |

*Primary Examiner*—A. D. Pellinen
*Assistant Examiner*—Geoffrey S. Evans
*Attorney, Agent, or Firm*—Parkhurst & Oliff

[57] ABSTRACT

An infrared ray heater unit, made of a ceramic plate carrying a resistive heater wire embedded therein, is mounted on the open end of a shallow box-like metallic case so as to emanate infrared rays, while a terminal insulator member having lead wire bosses and a securing means is inserted between the heater unit and the metallic case at the central portion of the heater unit. The metallic case has mounting holes through which the lead wire bossed and the securing means of the terminal insulator member extend, so that lead wires are connected to the infrared ray heater from the back of the metallic case at about its central portion.

4 Claims, 4 Drawing Figures

INFRARED RAY HEATER

BACKGROUND OF THE INVENTION

1. Field of the Invention

This invention relates to an improvement of the infrared ray heater having a resistive heater wire embedded in a ceramic board.

2. Related Art Statement

A typical conventional infrared ray heater of ceramic board type uses a thick porcelain plate which carries a resistive heater wire embedded on its heat radiating surface. The non-radiating surface of the porcelain plate has a swollen portion integrally formed therewith for facilitating the extraction of lead wires from the heater wire to the outside. Thus, the porcelain plate is made thick, resulting in a heavy weight and a large thermal capacity of the infrared ray heater. Accordingly it takes a long time for such heater to raise its temperature. Besides, the process for manufacturing such infrared ray heater has been complicated and its production cost has been high.

To avoid the above problems, the inventor has disclosed, in his Japanese Utility Model Laying-open Publication No. 26,194/85, an improved infrared ray heater which comprised a planar ceramic heater unit having a metallic resistive heater wire embedded in a porcelain plate and a heat-resistant insulation collar mounted on the non-radiating surface of the heater unit. A metallic cover is attached to the heat-resistant insulation collar, so as to cover the non-radiating surface of the ceramic heater unit.

In the infrared ray heater thus disclosed, the ceramic heater unit is disposed at about the central portion of the metallic case and secured to the heatresistant insulation, collar by a screw means, which insulation collar is in turn bolted to the metallic case. Lead wires from the heater unit are connected to terminals mounted on side portions of the metallic case. The infrared ray heater of such structure has short-comings in that its construction is complicated, that its assembling work is cumbersome and consumes much manpower, and that the insulation resistance between the ceramic heater unit and a reflector tends to be reduced when the temperature of the heater is high. In the worst case, the heater may be broken by overheating due to leakage current.

SUMMARY OF THE INVENTION

Therefore, an object of the invention is to overcome the above shortcomings of the prior art by providing an improved infrared ray heater.

To fulfill the above object, an infrared ray heater of the invention uses a terminal insulator member which has a pair of lead wire bosses and a fastening bolt boss formed between the lead wire bosses. Preferably, the lead wire bosses and the fastening bolt boss are of cylindrical shape. A planar ceramic heater unit is fitted in the open end of a metallic case of shallow box form while disposing the terminal insulator member therebetween at about the center of the heater unit. The metallic cover has mounting holes through which the lead wire bosses and the fastening bolt boss of the terminal insulator member extend.

The fastening bolt boss of the terminal insulator member holds a fastening bolt which has a threaded end protruding out of the fastening bolt boss. A heat-resistant insulation collar and an insulating end cap are mounted on the fastening bolt boss, so that the heat-resistant insulation collar and the sidewall of the insulating end cap surround such boss. The top plate of the insulating end cap has a hole through which the threaded end of the fastening bolt extends. A nut is coupled to the threaded end of that fastening bolt, so that the terminal insulator member is secured to the metallic cover. Lead wires from the ceramic heater unit are extracted to the outside through the lead wire bosses of the terminal insulator member.

In a preferred embodiment of the invention, the ceramic heater is fastened to the metallic cover by mounting a pair of coupler caps at opposite ends of the metallic case opening where the heater unit is fitted, so that the coupler caps join the facing portions of the metallic case and the heater unit.

A reflector may be disposed between the heat-resistant insulation collars and the insulating end cap. To this end, the nut is unscrewed from the fastening bolt to remove the insulating end cap from the fastening bolt, and the reflector is mounted on the heat-resistant insulation collars, while allowing both the lead wire bosses and the fastening bolt boss to extend through mounting holes of the reflector. Then, the insulating end cap is mounted on the reflector while passing the threaded end of the fastening bolt through the top plate hole of the insulating end cap. The nut is again screwed onto the threaded end of the fastening bolt, so that the reflector is secured to the terminal insulator member at a position between the heat-resistant insulation collars and the insulating end cap. When electricity is applied to the heater wire through the lead wires in the lead wire bosses, infrared rays are radiated from the radiating surface of the heater unit. Works can be heated by applying the thus radiated infrared rays thereto.

BRIEF DESCRIPTION OF THE DRAWINGS

For a better understanding of the invention, reference is made to the accompanying drawings, in which.

Figure 1:
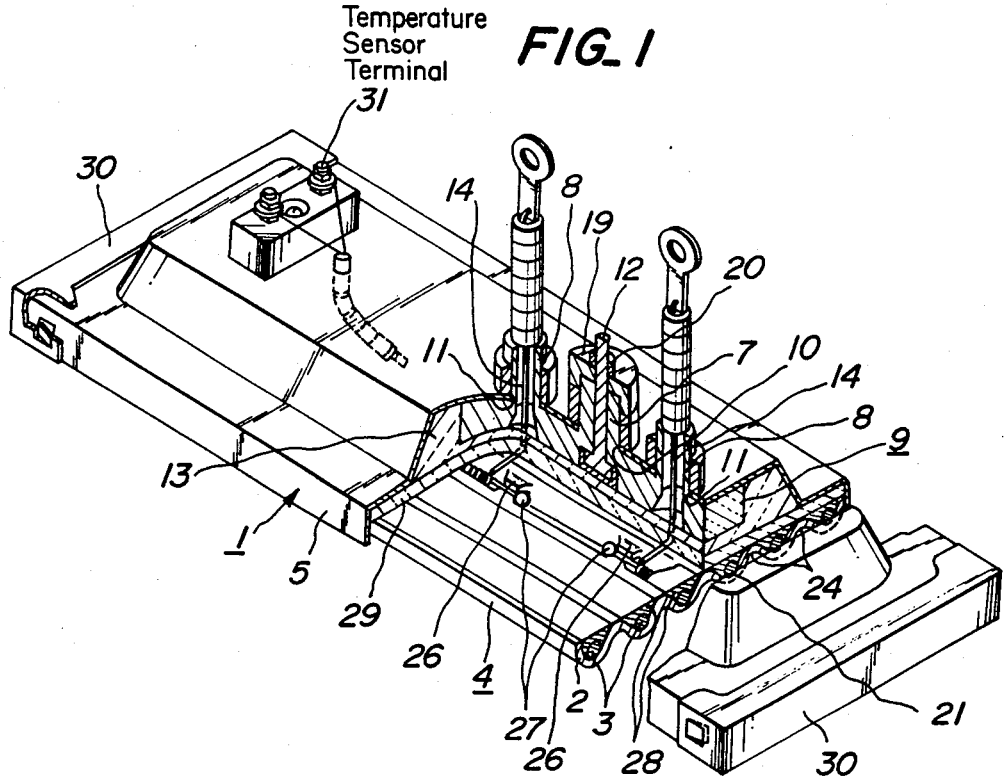
FIG. 1 is a partially cutaway perspective view of an infrared ray heater according to the present invention.
Figure 2:
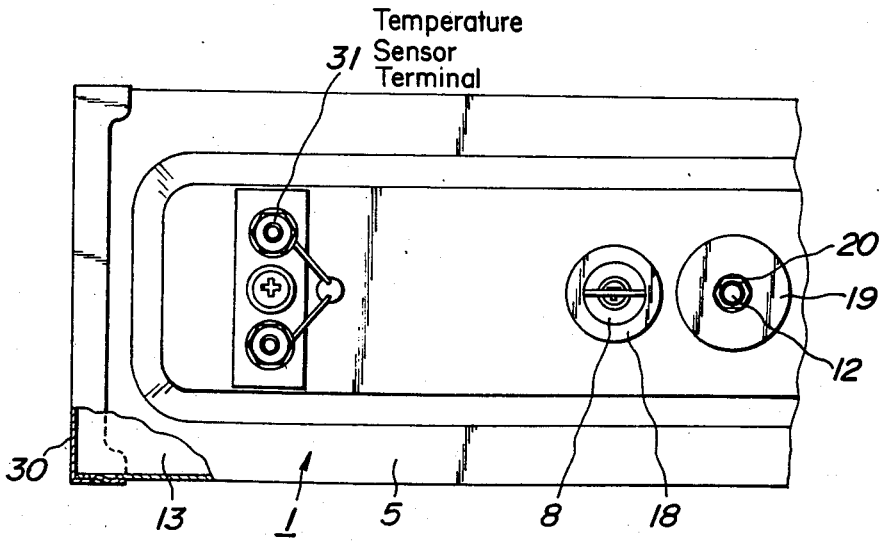
FIG. 2 is a partially cutaway plan view of an essential portion of the infrared ray heater of FIG. 1.

Throughout the different views of the drawings, 1 is an infrared ray heater, 2 is a ceramic board, 3 is a resistive heater wire, 4 is a ceramic heater unit, 5 is a metallic case, 7 is a fastening bolt boss, 8 is a lead wire boss, 9 is a terminal insulator member, 10 and 11 are porcelain member mounting holes, 12 is a fastening bolt, 13 is a heat-insulating material, 14 is lead wires, 15 is a planar reflector, 16 is a mounting hole, 17 is a heat-resistant insulation collar for the fastening bolt boss, 18 is a heat-resistant insulation collar for the lead wire boss, 19 is an insulating end cap, 20 is a nut, 21 is a zigzag-shaped groove, 22 is a straight portion, 23 is a bent portion, 24 is a partition, 25 is a right-angled portion, 26 is a narrow portion of the groove, 27 is a mounting terminal, 28 is a heat-resistive filler, 29 is a heat-resistive insulating plate, 30 is a coupler cap, and 31 is a temperature sensor terminal.

DESCRIPTION OF THE PREFERRED EMBODIMENT

A preferred embodiment of the invention will now be described in detail by referring to the drawings. The illustrated infrared ray heater 1 has a ceramic heater unit 4 which includes a ceramic board 2 with a thickness of about two millimeters. The ceramic board 2 is made by molding ceramic material having a high heat resistivity and a high thermal shock resistivity, such as cordierite powder, and baking the molded body. A resistive heater wire 3, preferably a coiled heater wire, is embedded in the ceramic board.

A terminal insulator member 9 has a pair of spaced lead wire bosses 8 and a fastening bolt boss 7 formed between the two lead wire bosses 8. In the illustrated embodiment, the bosses 7 and 8 are of cylindrical shape. The terminal insulator member 9 is placed on the non-radiating surface of the ceramic heater unit 4 at about the center thereof. The heater unit 4 is mounted on the open end of a metallic case 5 of shallow box form while placing the terminal insulator member 9 therebetween. A mounting hole 10 for the fastening bolt boss 7 and two mounting holes 11 for the lead wire bosses 8 are bored at the central portion of the metallic case 5, so that the bosses 7 and 8 extend through the mounting holes 10 and 11.

A fastening bolt 12 extends through the fastening bolt boss 7 of the terminal insulator member 9. The fastening bolt 12 has an enlarged head which is trapped between the terminal insulator member 9 and the ceramic heater unit 4. The opposite end of the fastening bolt 12 is threaded and protrudes out of the fastening bolt boss 7.

A suitable heat insulating material 13 is stuffed in gaps between the ceramic heater unit 4 and the metallic case 5. The terminal insulator member 9 is tightly connected to the metallic case 5 as will be described hereinafter. Lead wires 14 from the resistive heater wire 3 of the ceramic heater unit 4 are extracted to the outside through the lead wire bosses 8.

A heat-resistant insulation collar 17, made of ceramic material such as alumina porcelain, is mounted on the fastening bolt boss 7 so as to surround it. An insulating end cap 19 made of similar ceramic material is mounted on top of the heat-resistant insulation collar 17. The top wall of the end cap 19 has a hole through which the threaded end of the fastening bolt 12 extends. A nut 20 is screwed on the threaded end of the fastening bolt 12 so as to join the terminal insulator member 9 to the metallic case 5.

Besides, the lead wire bosses 8 may be provided with heat-resistant insulation collars 18 which are similar to the collar 17 for the fastening bolt boss 7. A planar reflector 15, such as a stainless steel sheet, can be disposed between the heat-resistant insulation collars 17, 18 and the insulatingl end cap 19. In the illustrated embodiment, the planar reflector 15 has mounting holes 16 through which the bosses 7, 8 extend.

To mount the reflector 15, the nut 20 and the insulating end cap 19 are removed from the threaded end of the fastening bolt 12, and the heat-resistant insulation collars 18 are mounted on the lead wire bosses 8 in the same manner as the heat-resistant insulation collar 17 on the fastening bolt boss 7. When the reflector 15 is mounted on the heat-resistant insulation collars 17, 18, it is spaced from the metallic case 5 by a distance corresponding to the height of the collars 17, 18. Then, the insulating end cap 19 is mounted on the thread end of the fastening bolt 12 and the nut 20 is again screwed on the bolt 12, so that the reflector 15 is mounted on the infrared ray heater 1 with the heatresistant insulation collars 17, 18 inserted therebetween.

Figure 3:
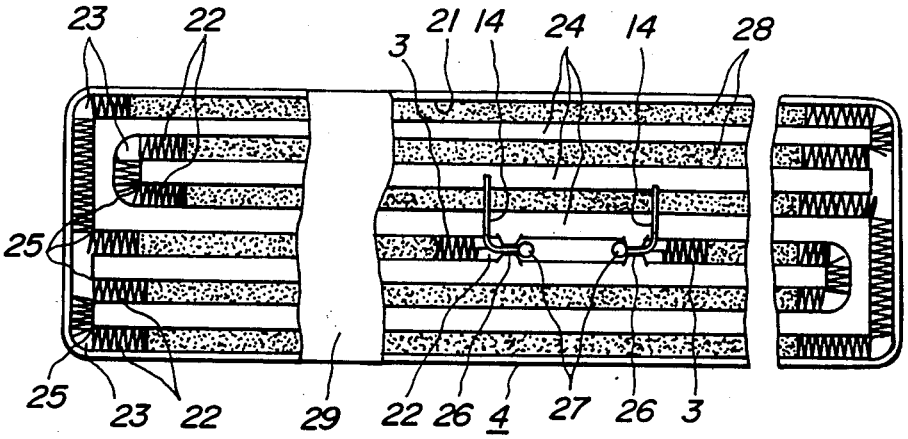
FIG. 3 is a partially cutaway plan view of a ceramic heater unit to be incorporated in the infrared ray heater of FIG. 1.
Figure 4:
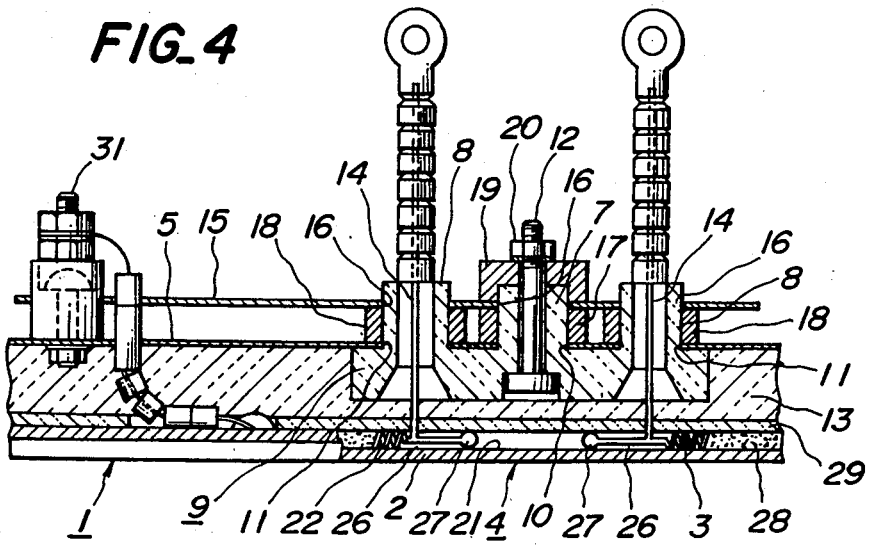
FIG. 4 is a vertical sectional view of the central portion of an infrared ray heater having a reflector mounted thereon.

Referring to FIG. 3, the non-radiating surface of the ceramic board 2 of the ceramic heater unit 4 has a zigzagged groove 21 in which the resistive heater wire 3 is placed. More particularly, the groove 21 has a number of straight portions 22 connected by bent portions 23, so as to provide a continuous recess for receiving the heater wire 3. The radiating surface of the ceramic board 2 has a wall of substantially uniform thickness, which wall is waved at a substantially uniform pitch as shown in FIG. 1. Parallel portions of the zigzagged groove 21 are separated by partition walls 24. The shape of longitudinal ends of the partition walls 24 are such that, the inner sidewall of each bent portion 23 is defined by a right-angled edge 25 of the partition wall 24 while the outer sidewall of the curved portion 23 is defined by a semicircular curved part of the partition wall 24, as shown in FIG. 3. Here, the "inner sidewall" refers to the one which is closer to the center of curvature of the bent portion 23 than the sidewall opposite to it.

A pair of narrow portions 26, 26 of the groove 21 are formed on the straight portion 22 at about the center of the ceramic board 2, for instance, by providing projections from the partition walls 24, 24 on opposite side of the straight portion 22 of the groove 21. Each of the lead wires 14, made of stranded heat-resistant metallic wires, is connected to the corresponding end of the resistive heater wire 3 by welding, so that ball-like terminal portions 27 are formed at the opposite ends of the heater wire 3. The narrow portions 26 of the groove 21 are such that the ball-like terminal portions 27 are firmly held by the narrow portions 26 respectively. The resistive heater wire 3 is placed in the zigzagged groove 21 while applying a tension thereto. At each bent portion 23 of the groove 21, the inner side of the curved heater wire 3 is tightly urged against the right-angled portion 25 of the partition wall 24 due to its resiliency under tension or the so-called spring back effect.

After the resistive heater wire 3 is placed in the zigzagged groove 21, a suitable heat-resistive filler 28 is stuffed in the vacant portions of the groove 21. Preferably, the filler 28 consists of colloidal silica type filling material and an adhesive such as sodium silicate or aluminium phosphate, so that it hardens at room temperature. Finally, a heat-resistive insulating plate 29 is bonded to the non-radiating surface of the ceramic board 2, so as to complete the ceramic heater unit 4.

In the illustrated example, the ceramic heater unit 4 is placed in an open end of the metallic case 5 of a shallow box form. The opposite ends of the ceramic heater unit 4 and the facing opposite ends of the metallic case 5 are joined by coupler caps 30. For instance, the peripheral sidewall of each coupler cap 30 resiliently holds both one end portion of the metallic case 5 and the facing end portion of the ceramic heater unit 4 so as to join them.

In the figures, the numeral 31 represents the terminal of a temperature sensor disposed in the ceramic heater unit 4, which temperature sensor is made of a thermoelectromotive material such as PLATINEL (trade mark).

The structure of the infrared ray heater 1 according to the invention is not restricted to the above embodiment. For instance, the ceramic heater unit 4 need not be planar but it can have a curved surface. The resistive heater wire 3 of coiled type may have a larger pitch at the central portion of the ceramic heater unit 4 than the peripheral portion thereof, so as to homogenize heat radiation therefrom and to prevent local overheating at the central portion due to thermal interference. The partition wall 24 may be thicker in the central portion of the ceramic heater 4 than in the peripheral portion thereof for the same purpose as the coil pitch of the heater wire 3.

Furthermore, the number of the fastening bolt boss 7, surrounded by the heat-resistant insulation collar 17 and the insulating end cap 19 and carrying the fastening bolt 12 for securing the terminal insulator member 9 and the reflector 15 to the metallic case 5 of the infrared ray heater 1, is not restricted to one as in the case of the above embodiment. In fact, two or more of such fastening bolt bosses 7 can be provided in alignment with a line connecting the two lead wire bosses 8, 8, so as to secure the terminal insulator member 9 and the reflector 15 to the metallic case 5 more firmly. Such fastening bolt bosses 7 may be provided as separate members from the terminal insulator member 9.

When an electric current is applied to the resistive heater wire 3 of the ceramic heater unit 1 through the lead wires 14, 14, infrared rays emanate from the radiating surface of the ceramic heater unit 4. With the above-mentioned structure of the invention, the infrared ray heater can be made lighter than that of the conventional structure having a swollen central portion for the extraction of lead wires and the time necessary for raising the heater temperature from cold state can also be shortened to a great extent.

One of the features of the inventions is that the lead wire bosses 8, 8 and the fastening bolt boss 7 are concentrated at the central portion of the metallic case 5 by using the terminal insulator member 9 having such bosses formed as an integral part thereof. Another feature of the invention is in that the reflector 15 can be mounted to the infrared ray heater 1 with a spacing from the metallic case 5 and with a complete electric insulation therefrom, because the heat-resistant insulation collars 17, 18 are mounted on the fastening bolt bosses 7 and the lead wire bosses 8 for the purpose of the above separation. Besides, such reflector 15 can be easily mounted by unscrewing and re-screwing of the nut 20 accompanied with removal and re-moving of the insulating end cap 19.

Due to the above features, the structure of the infrared ray heater is greatly simplified and considerable saving is acheived in the wiring and assembling operations. Furthermore, the insulation resistance between the charged portion and the earth is greatly improved by the use of the heat-resistant insulation collar 17 in combination with the insulating end cap 19 so that even if the ceramic heater 4 is heated to 900° C. or higher, there is no risk of thermal breakage of the infrared ray heater due to leakage current.

It should be noted here that when the right-angled portions 25 are formed at opposite longitudinal ends of the partition wall 24 between adjacent straight portions 22 of the zigzagged groove 21 in the ceramic board 2 of the heater unit 4, as shown in the drawing, the inner side of the curved portion of the heater wire 3 in the curved portion 23 of the groove 21 is strongly urged against such right-angled corner 25 by the so-called spring back effect. Thus, the heater wire 3, whose terminals 27 are held by the narrow portions 26 of the groove 21, can be easily fitted in and resiliently held by the zigzagged groove 21 without using any extra tools or jigs. Such fitting and holding of the heater wire 3 are available even if the zigzagged groove 21 is of complex shape.

Since the curved portion of the heater wire 3 in the bent portion 23 of the groove 21 comes in contact with the sharpened edge of the right-angled portion 25 of the partition wall 24, adjacent circular portions of the coiled wire 3 are always separated from each other so that seizing of the adjacent circular portions of the wire 3 as experienced with the semicircular corner of the partition wall 24 can be completely eliminated. Thus, local overheating during an operation with a large current, which may lead to a thermal breakdown, can be prevented.

As described in the foregoing, lead wires 14 are welded to the opposite ends of the coiled heater wire 3 to form ball-like terminal portions 27 which are held by the narrow portion 26 of the groove 21 of the ceramic board 2. The lead wires 14 can be extracted to the outside at the central portion of the non-radiating surface of the infrared ray heater 1 in a very easy manner through the lead wire bosses 8, 8. Accordingly, various wall members of the heater 1 can be made thin to make it lightweight, and the work of wiring and assembling can be simplified.

The central portion of the ceramic heater unit 4, which is susceptible to local heating by the thermal interference from its surroundings, does not produce excessive heat because the part between the two narrow portions 26, 26 does not have any heater wire 3. Consequently, the homogenization of the heat emanation from the radiating surface of the ceramic heating unit 4 can be achieved without necessitating adjusting the coiled pitch of the resistive heater wire 3 and the thickness of the partition wall 24. In short, the infrared ray heater according to the invention, has a long service life and an excellent temperature distribution.

Therefore, the invention has succeeded in both overcoming the difficulties experienced with conventional infrared ray heaters and providing a high practicable infrared ray heater.

What is claimed is:

1. An infrared ray heater comprising:

an infrared ray heater unit made of a ceramic board with a zigzag-shaped continuous groove formed on one side surface thereof and a resistive heater wire disposed in the groove, said groove having a pair of narrow portions at a central part of the ceramic board so as to hold the opposite ends of the heater wire at the narrow portions of the groove;

a heat-insulating material disposed on said ceramic board, said heat insulating material having a recess;

a terminal insulator member disposed on said recess of heatinsulating material, which insulator member has a pair of lead wire bosses extending away from said terminal insulator member at positions aligned with the narrow portions of said groove respectively and a fastening bolt boss extending away from said terminal insulator member at an intermediate position between the two lead wire bosses, the fastening bolt boss holding securely one end of a fastening bolt, said fastening bolt having a threaded end extending in a direction away from the ceramic board;

a metallic case overlying on both said terminal insulator member, said heat-insulating material and said ceramic board, said metallic case having holes through which said lead wire bosses and said fastening bolt boss extend away from said ceramic board;

a first heat-resistant insulation collar for the fastening bolt boss and a second heat-resistant insulation collar for the lead wire boss placed on said metallic case so as to surround said fastening bolt boss and said lead wire bosses, respectively;

a planar reflector disposed on said first and second heat-resistant insulating collars;

an insulating end cap placed on said first heatresistant insulation collar so that a sidewall of the end cap surrounds said fastening bolt boss, said insulating end cap having a hole bored through a flat end portion thereof so as to allow said threaded end of the fastening bolt to extend therethrough;

a nut screwed on said threaded end of the fastening bolt so as to combine said infrared ray heater unit, said terminal insulator member, and said metallic case; and a pair of lead wires which are connected to said opposite ends of the heater wire at said narrow portions of the groove and extend through the lead wire bosses respectively; and a pair of coupler caps which engage opposite ends of both said metallic case and said ceramic board respectively so as to couple tightly the ceramic board to the metallic case;

whereby said ceramic board of the infrared ray unit, terminal insulator member, metallic case and planar reflector are secured together by the fastening bolt and nut together with the first and second heat-resistant insulation collars for the fastening bolt boss and for the lead wire boss respectively and the insulating end cap so as to improve the heat-resistive insulating ability.

2. An infrared ray heater as set forth in claim 1, wherein a heat-resistive insulator plate is disposed between said ceramic board and said heat insulating material.

3. An infrared ray heater as set forth in claim 1, wherein a temperature sensor terminal is connected to said groove of ceramic board for sensing the temperature of ceramic board.

4. An infrared ray heater as set forth in claim 1, wherein a heat resistive filler is packed in the groove of the ceramic board at both side ends of the resistive heater wire inserted in said groove.

* * * * *